United States Patent [19]

Fröhlich et al.

[11] 3,965,833

[45] June 29, 1976

[54] SLIDE-FASTENER STRINGER WITH WARP-KNIT SUPPORT TAPES

[75] Inventors: Alfons Fröhlich; Marie-Luise Cappel, both of Essen, Germany

[73] Assignee: Opti-Holding AG, Glarus, Switzerland

[22] Filed: Oct. 3, 1974

[21] Appl. No.: 511,676

[30] Foreign Application Priority Data

Oct. 6, 1973 Germany ..... 2350318

[52] U.S. Cl. ..... 112/265; 66/202

[51] Int. Cl.[2] ..... D05B 97/10

[58] Field of Search ..... 66/195, 190, 191, 192, 66/193, 194, 202; 112/265

[56] References Cited

UNITED STATES PATENTS 3,708,836 1/1973 Frohlich et al. ..... 112/265 X

FOREIGN PATENTS OR APPLICATIONS 2,059,003 5/1971 France ..... 66/202

2,094,620 2/1972 France ..... 66/202

*Primary Examiner*—Alfred R. Guest

*Attorney, Agent, or Firm*—Karl F. Ross; Herbert Dubno

[57] ABSTRACT

A slide-fastener stringer foundation is formed of support tapes which are warp-knit. Two different types of weft filaments are used, one being textured and of limited shrinkability and the other being highly shrinkable. The tape so knitted is heat-shrunk so as to cause the shrinkable yarn to form the textured yarn into a mass of bulges or loops on the surface of the tape, thereby imparting to this tape a very smooth texture.

3 Claims, 5 Drawing Figures

SLIDE-FASTENER STRINGER WITH WARP-KNIT SUPPORT TAPES

CROSS-REFERENCE TO COPENDING APPLICATION

This application is related to copending application Ser. No. 353,771, filed on 23 Apr. 1973 (U.S. Pat. No. 3,840,946) as a continuation-in-part of application Ser. No. 82,323 and application Ser. No. 82,326, both filed on 20 Oct. 1970 (U.S. Pat. Nos. 3,757,541 and 3,762,002, respectively).

FIELD OF THE INVENTION

The present invention relates to a method of making a slide-fastener stringer and, more particularly, to knit support tapes for such a slide-fastener stringer.

BACKGROUND OF THE INVENTION

As a rule the support tapes for a slide-fastener stringer are made of synthetic-fiber yarns, that is, yarns either wholly or principally made of synthetic-resin fibers. The use of this type of yarn is mandated by the requirement that the support tapes have virtually no elasticity, that is that they be virtually unstretchable so that the spacing between adjoining coupling heads of a coupling element secured to the edge of such a support tape will remain the same at all times. For this reason natural fibers such as wool are not used as these fibers are almost invariably elastic. Support tapes are generally formed of polyester or polyamide yarn which are subjected to a so-called thermofixing operation which shrinks and sets the yarns.

The disadvantage of such a slide-fastener stringer is that when used in a slide fastener and mounted in a garment it is obviously made of textile material which is often disadvantageous in certain types of garments. In addition the tape is relatively hard so that when lying directly against the skin can often be rather uncomfortable. Another difficulty is encountered in stitching the coupling elements to the edge of the tape, since the inevitably rather hard tape is rather difficult to sew.

OBJECTS OF THE INVENTION

It is therefore an object of the present invention to provide an improved method of making a slide-fastener stringer same.

Another object is the provision of a stringer support tape which has the same appearance as if it were made of wool or natural fibers, but which still has all of the advantages of a tape made of synthetic fibers.

A further object is to provide an improved support tape adapted to have a slide-fastener coupling element stitched to its edge.

SUMMARY OF THE INVENTION

These objects are attained according to the present invention in a support tape formed of knit smooth yarns made of synethetic fibers wherein textured yarns are used which bulge on the upper end or lower faces of the tapes. Thus according to the present invention in a support tape formed by warp knitting, that is comprising wale-forming warp yarns and course-forming weft yarns, at least some of the weft yarns are formed of textured fibers.

According to another feature of this invention both textured yarns and highly shrinkable yarns are used as the laid-in weft yarns so that when the knitted tape is subjected to a subsequent heat treatment the highly shrinkable yarn contracts and form the textured yarns into loose loops or bulges that give the surface of the support tape a very smooth and soft texture.

Thus, in accordance with the present invention the highly shrinkable yarn is laid in the weft in a 2-2/0-0 pattern while the textured yarn is laid in a 4-4/0-0 pattern, this terminology being described in the above-cited patents. In addition the textured as well as the smooth weft yarns can be oppositely patterned or, in order to obtain maximum transverse stability the smooth weft yarns, that is the highly shrinkable yarns, can be laid in a 4-4/0-0 or 0-0/4-4 pattern.

The support tape according to the present invention has all of the advantages of a wool or natural-fiber support tape, while at the same time it retains the advantageous nonstretching characteristics of synthetic-fiber tapes. This is achieved by the use of only a small portion of the textured yarns which are so employed that they form bulges or loops on the surface of the tape giving it the above-mentioned soft appearance and texture. This also facilitates stitching of the coupling elements to the tape and stitching of the tape into a garment; in particular this is true when textured yarns are used in the weft of the tape.

In accordance with the present invention the textured yarn which forms the relatively loose loops or bulges on the surface of the tapes is caused to form these bulges by forming the tape with yarns that shrink more than the textured yarn so that after shrinking the textured yarn which was laid in with the same tension is substantially looser. It is also possible to simply feed the textured yarn to the knitting machine at very low tension so as to achieve this effect.

The coupling element according to the present invention can be woven or knitted right into the edge of the support tape. It is also possible to stitch the coupling element to this support tape. In this latter case the support tape is knitted such that along its edge it is formed with a series of holes. The coupling element is stitched to this edge of such a tape by passing the stitching thread or threads through the tape at these holes, thereby facilitating the stitching operation while avoiding the possibility that the sewing itself could damage the tape.

In accordance with another feature of this invention the tape is only heat treated so as to shrink the highly shrinkable weft yarns after the coupling element has been mounted thereon so that the connection between this coupling element and the tape is extremely strong.

BRIEF DESCRIPTION OF THE DRAWING

The above and other objects, features, and advantages of the invention will become more readily apparent from the following description, reference being made to the accompanying drawing, in which.

SPECIFIC DESCRIPTION

Figure 1:
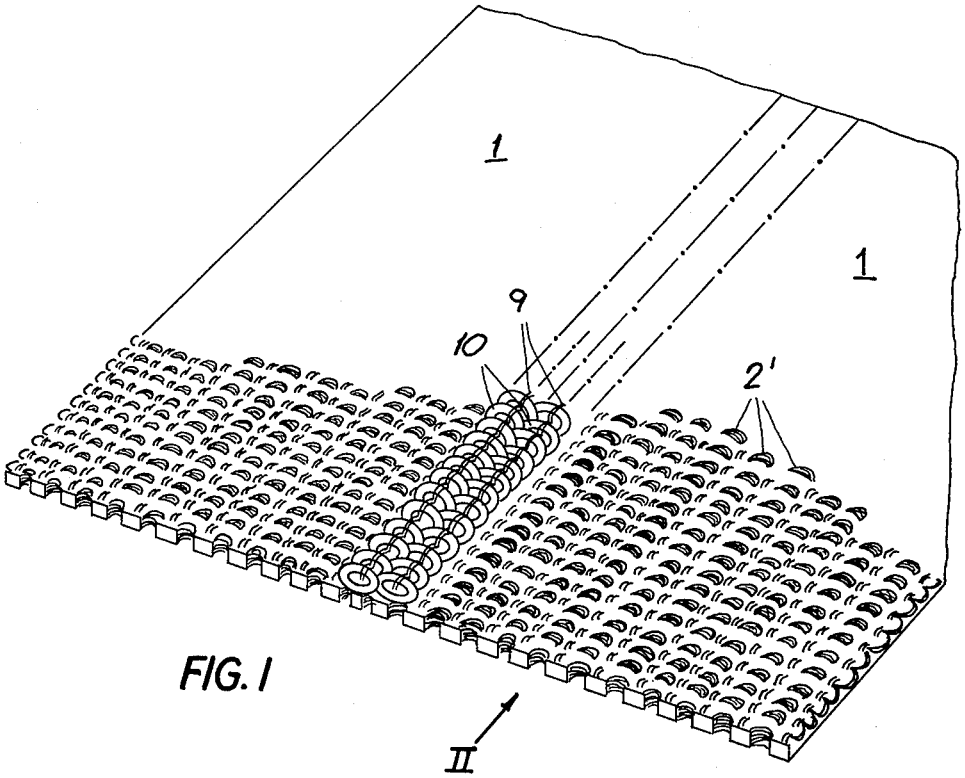
FIG. 1 is a perspective view of a slide-fastener stringer according to the present invention.
Figure 2:
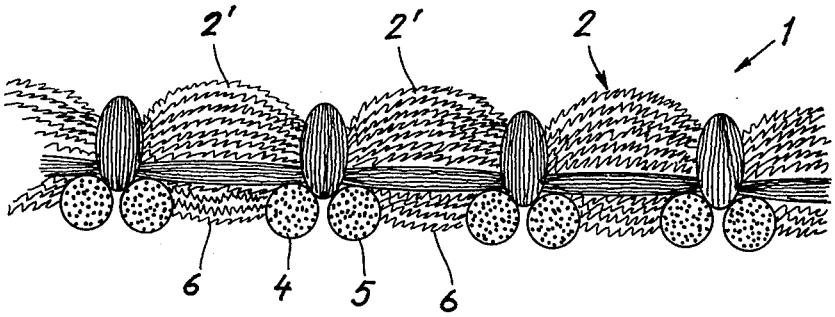
FIG. 2 is a view taken in the direction of arrow II of FIG. 1, in enlarged scale.

As shown in FIGS. 1 and 2 a slide-fastener stringer according to the present invention comprises a pair of support tapes 1 provided at their edges with continuous multi-turn coupling elements 10 secured to these edges by respective rows of stitching 9.

Figure 3:
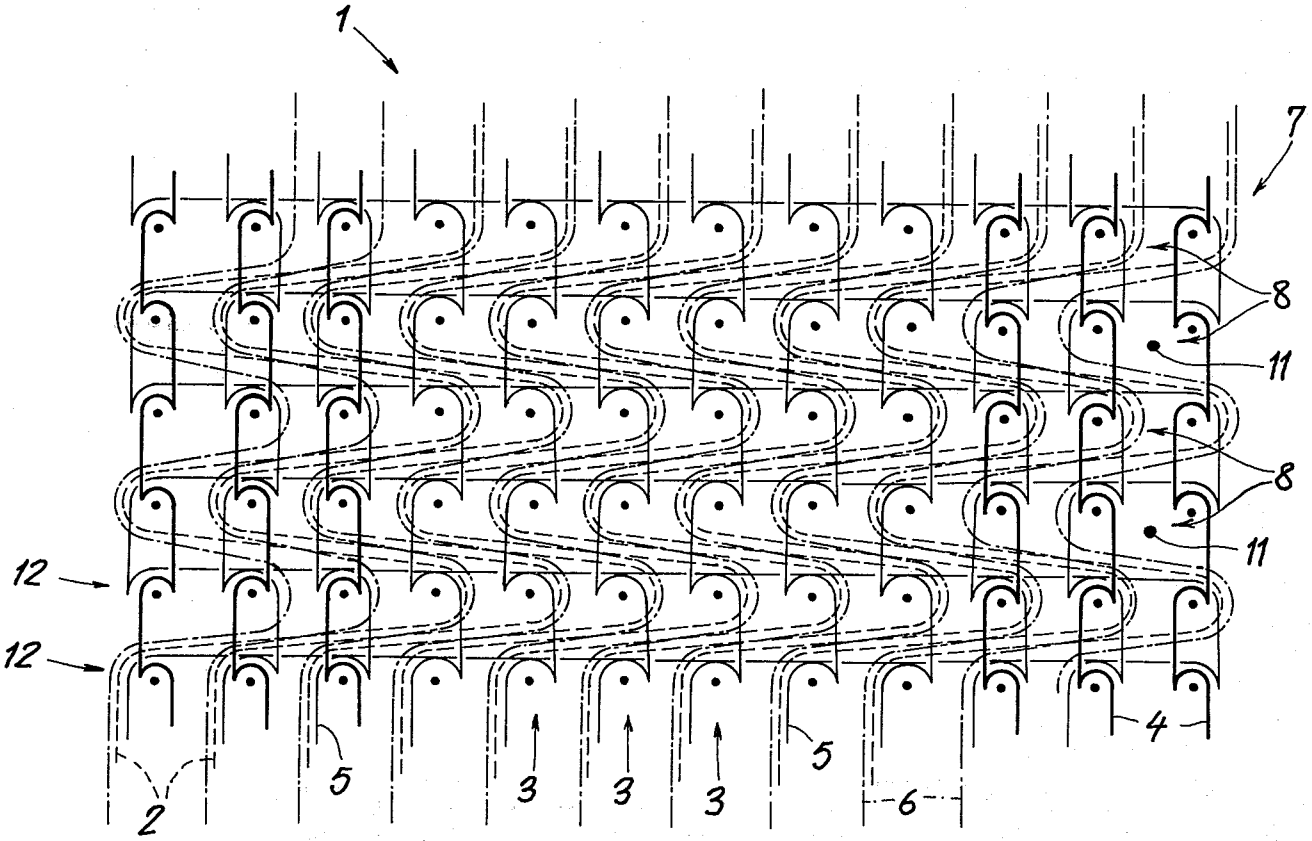
FIG. 3 is the combined point-paper notation for a support tape according to the present invention.
Figure 4:
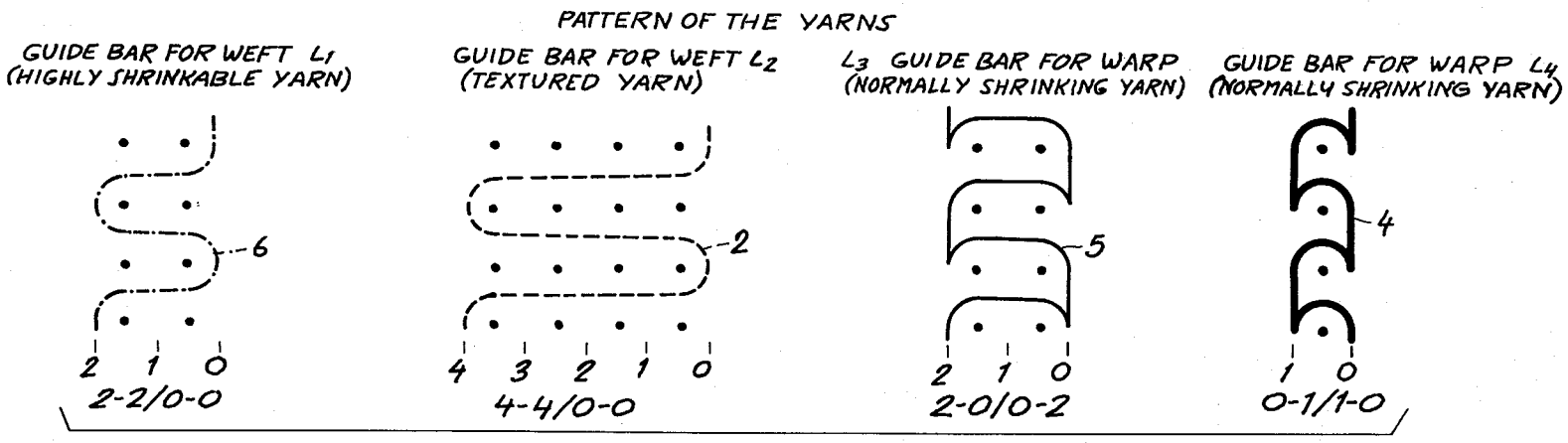
FIG. 4 is a diagram illustrating the guide-bar movement for producing the knit tape of FIG. 3.

Each of the support tapes 1 as illustrated in FIGS. 2, 3 and 4 is formed of normally shrinking warp yarns 4 and 5 forming wales 3, of a textured weft yarn 2 and a highly shrinkable weft yarn 6 forming courses 12. FIG. 3 represents standard tricot notation wherein each dot stands for a needle. The vertical rows of dots symbolize the wales 3 and horizontal rows symbolize the courses 12. The lines passing around the dots represent the paths of the guides during knitting and therefore the pattern of the yarns carried by these guides. FIG. 4 shows the paths of the individual guides.

Thus for the knit of interest here two types of guide-bar movement are seen. The guide bars $L_3$ and $L_4$ for the normally shrinking warp yarns 4 and 5 can move from one space to another during each knitting cycle, that is during the formation of each course, then move back during the next raising and lowering of the needles. For example, the figure notation for a guide which moves from space 0 to space 1 during one knitting cycle and then back from space 1 to space 0 during the next cycle is 0-1/1-0, with the slash mark separating the two cycles. This is the pattern for yarn 4. Similarly the yarn 5 is laid in in a 2-0/0-2 pattern wherein its guide bar $L_3$ moves from space 0 to space 2 during one knitting cycle and then from space 2 back to space 0 during the next cycle.

The yarns 6 and 2 are laid in by their guide bars $L_1$ and $L_2$. In this case the guides $L_1$ and $L_2$ do not move in front of the needles (overlap) but merely shog back and forth behind the needles between cycles. The notation here is similar so that the notation 4-4/0-0 for textured yarn 2 corresponds to a guide motion wherein as the needles move up and down for one course the guide bar $L_2$ stands in space 4, then moves to space 0 where it remains as the next course is knit. In other words, the first two digits of the notation signify the two positions between which the guide reciprocates during one knitting cycle and the second two digits indicate the end positions for the next cycle. After every two cycles the movements are repeated. Since for laying-in the guides do not move during the knitting cycle, but between them, both numbers are the same on each side of the slash mark. The yarn 6 is laid in in a 2-2/0-0 pattern wherein the guide bar merely shogs back and forth between space 2 and space 0 between knitting cycles.

Since the end three guides for the yarn 2 and the corresponding end guide for the yarn 6 are not threaded in order to form a clean edge 7 on the tape 1, holes 8 are formed along this edge 7 of the fabric. In accordance with the present invention the stitching 9 for the coupling elements 10 passes through the tapes 1 as shown at 11 in these holes 8.

Figure 5:
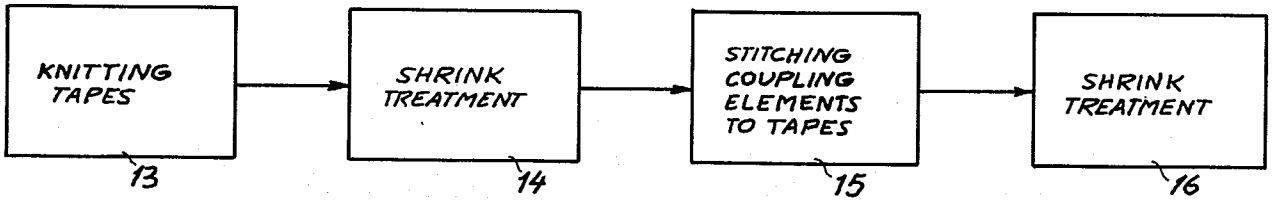
FIG. 5 is a schematic block diagram illustrating the method according to the present invention.

With reference to FIG. 5, the tapes are knitted according to the present invention in a knitting machine 13 whereupon they may be shrunk in a shrink tunnel as indicated at 14. Thereafter the coupling elements are stitched to the tape by a sewing machine 15 and if the slide-fastener stringer foundation so formed has not already been shrunk the assembly is passed through a shrink tunnel 16. Only one of the shrink-treatment devices 14 or 16 need be provided.

It should be clear that with the system according to the present invention the yarn 6 will shrink a great deal more than the yarn 2 so as to contract the tapes 1 transversely and cause the formation of bulges 2' as clearly indicated in FIG. 2. Since these bulges 2' are formed in the textured yarn, which has been preshrunk and is therefore substantially less shrinkable than the yarn 6, they will impart to the surface of the tapes 1 a very smooth and agreeable texture.

We claim:

1. A method of making a slide-fastener stringer tape comprising the steps of:

continuously forming a substantially nonstretchable knit warp of only smooth synthetic yarns;

continuously laying into said warp textured synthetic weft yarns and highly shrinkable smooth synthetic weft yarns; and thereafter shrinking said highly shrinkable yarns transversely of the tape to form said textured yarns into a mass of bulges on at least one face of said tape within meshes formed by the smooth yarns.

2. The method defined in claim 1, further comprising the step of leaving along an edge of said tape a series of stitch-free holes and sewing a coupling element to said edge with stitching passing through said holes.

3. The method defined in claim 2 wherein said highly shrinkable yarns are shrunk after said element is sewn to said edge.

* * * * *